US006487298B1

(12) United States Patent
Hacker

(10) Patent No.: US 6,487,298 B1
(45) Date of Patent: Nov. 26, 2002

(54) MICROPHONE STAND SOUND MONITOR

(76) Inventor: Scott A. Hacker, 6 Campbell La., Linden, PA (US) 17744

( * ) Notice: Subject to any disclaimer, the term of this patent is extended or adjusted under 35 U.S.C. 154(b) by 0 days.

(21) Appl. No.: 09/430,062

(22) Filed: Oct. 29, 1999

Related U.S. Application Data

(60) Provisional application No. 60/106,504, filed on Oct. 30, 1998.

(51) Int. Cl.[7] ..... H04R 25/00

(52) U.S. Cl. ..... 381/363; 381/386; 381/387; 181/199

(58) Field of Search ..... 381/300, 301, 381/303, 304, 305, 306, 307, 310, 332, 333, 334, 361, 365, 366, 386, 388, 390, 387; 181/148, 199

(56) References Cited

U.S. PATENT DOCUMENTS 3,526,718 A * 9/1970 Beatty ..... 381/363
4,187,395 A * 2/1980 Hewson ..... 381/300
4,199,657 A * 4/1980 Lane ..... 381/386
4,475,226 A * 10/1984 Greenberg ..... 381/300

* cited by examiner

*Primary Examiner*—Binh Tieu
*Assistant Examiner*—Suhan Ni
(74) *Attorney, Agent, or Firm*—John J. Elnitski, Jr.

(57) ABSTRACT

The present invention provides a microphone stand mounted monitor which is closer to the performer, eliminates the use of precious floor space, uses less power, allows for a lower output volume on the stage and is adjustable in height. The microphone stand mounted monitor includes a cabinet, at least one speaker in the cabinet and a mounting system. The monitor mounts to a microphone stand by sliding the cabinet over a shaft with the microphone adapter removed, so that the shaft is inserted into holes of the cabinet. The holes are positioned so that the cabinet is about waist height of the performer and the speakers of the cabinet are pointed towards the head of a performer. An isolation tube is mounted inside the cabinet between the holes. The isolation tube provides a guide for the shaft and protects the internal parts of the cabinet from the shaft. The isolation tube also aids in sealing the cabinet and preventing leakage of sound from the cabinet. Sealant can be applied between the holes and the isolation tube.

12 Claims, 9 Drawing Sheets

MICROPHONE STAND SOUND MONITOR

This application claims the benefit of U.S. Provisional Application No.: 60/106,504 filed Oct. 30, 1998.

BACKGROUND

The present invention relates sound monitors used by performers, mainly vocalists, on stage. The monitor is a speaker cabinet with at least one speaker inside the cabinet. The monitor allows an individual performer to monitor a mixture of instruments and voice on stage during the performance. On stage the mixture of instruments and voice are usually controlled by a sound person using a mixing console. The sound hear by the audience is know as the main mix. The mix of at least the vocal mix is amplified back on stage through the monitor. Usually, each performer has an individual monitor unit for their own use of monitoring their own performance. The typical monitor employed is a floor monitor. The floor monitor is a floor mounted speaker cabinet with at least on speaker inside. The floor monitor is usually placed angled slightly upward and in front of the performer and his microphone stand. The sound from the floor monitor usually must travel from seven (7) to fifteen (15) feet before reaching the performer. The stage is a very noisy place due to all of the instruments, so the performer usually wants the output volume of the monitor to be very loud in order to cut through all of the stage noise and the main mix. On smaller stages, such as night clubs, the main mix can be overpowered by the sound from the floor monitors. Also, the floor monitors take up limited floor space on the stage.

SUMMARY OF THE INVENTION

The present invention provides a sound monitor having a cabinet with A top, bottom and two sides. There is at least one speaker in the cabinet. The cabinet has a first hole in said top and a second hole in said bottom. The first and second holes aligned and are adapted to receive a shaft projecting thru said cabinet. The holes are positioned such that said cabinet is angled towards a user when placed on said shaft. The sound monitor also includes a collar which mounts to the shaft before said cabinet and supports said cabinet on said shaft. The cabinet can further include an isolation tube between said holes to act as a guide for said shaft and protect the internal parts of the cabinet from damage from said shaft.

DETAILED DESCRIPTION OF INVENTION

Figure 1:
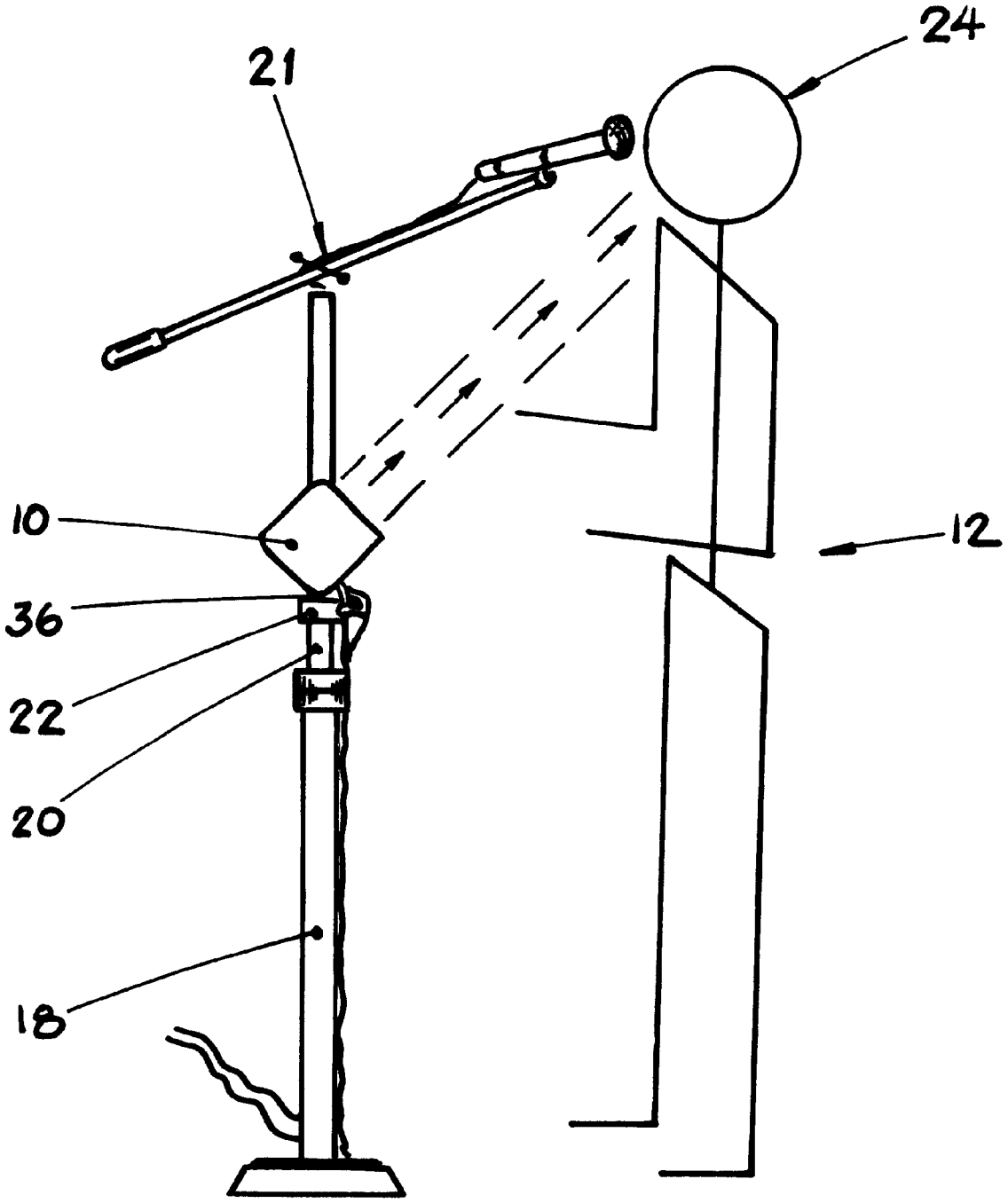
FIG. 1 is a perspective view of the sound monitor on a microphone stand according to the present invention.
Figure 2:
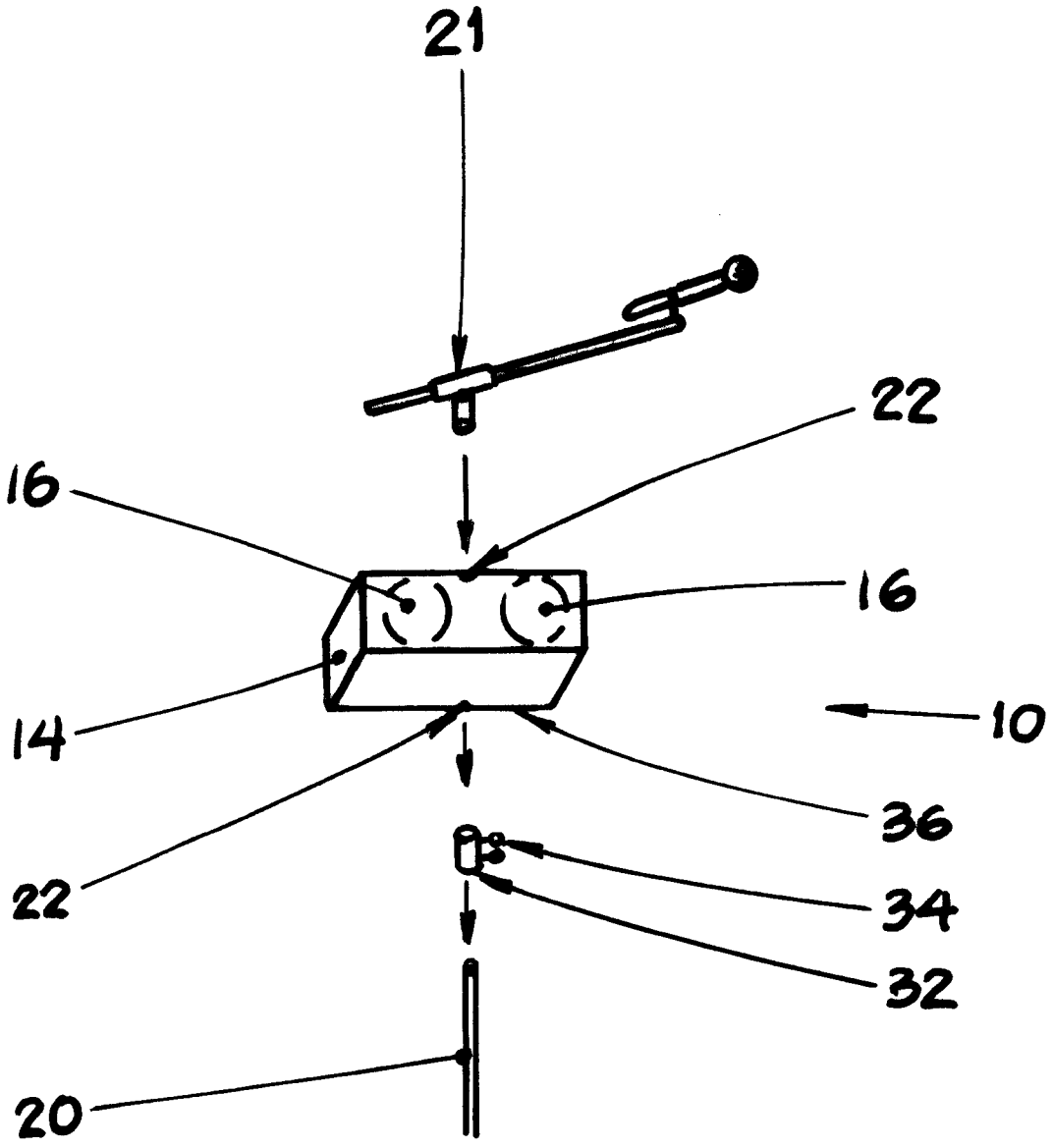
FIG. 2 is an exploded view of a sound monitor on a microphone stand according to the present invention.
Figure 3:
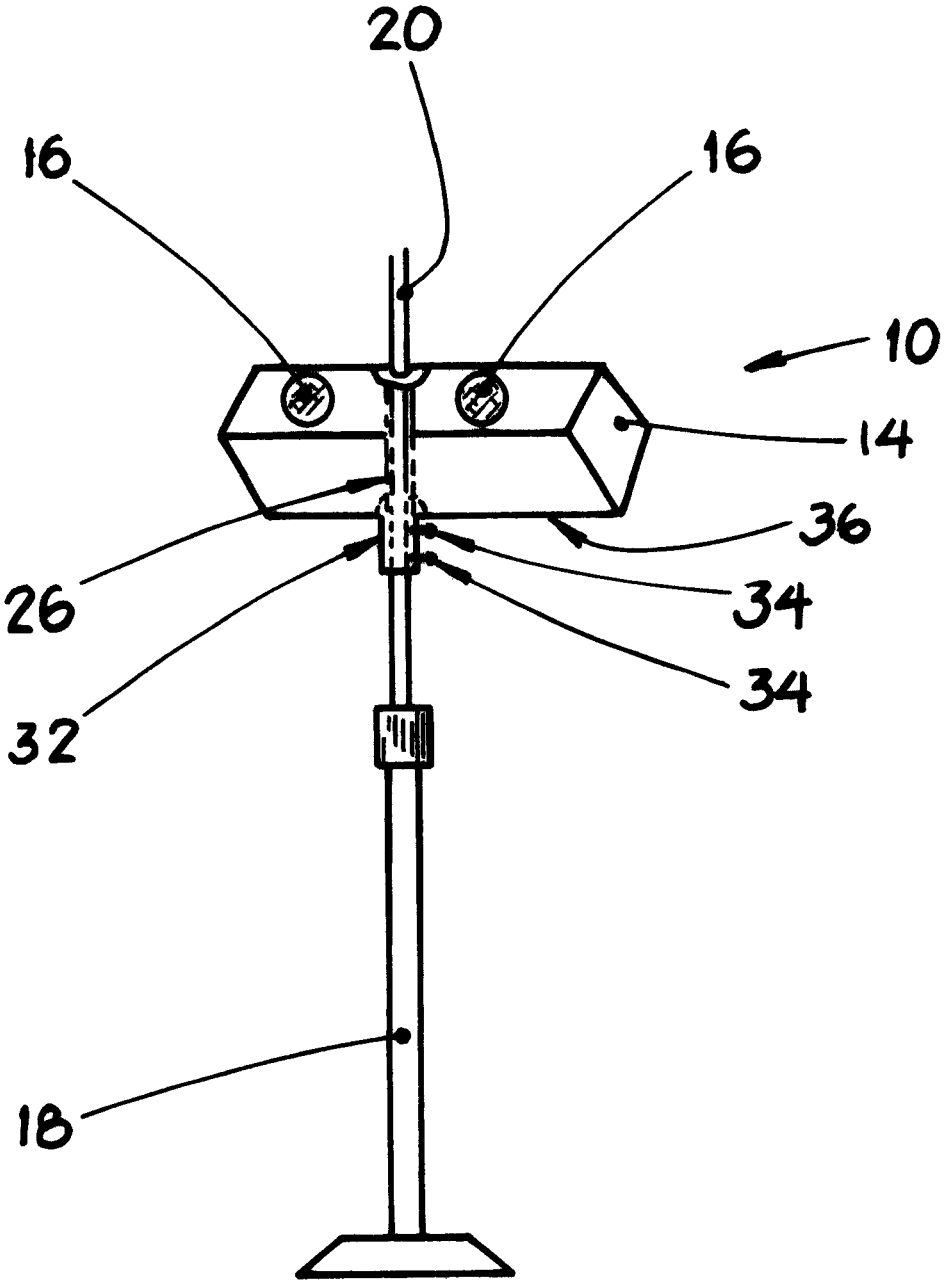
FIG. 3 is a perspective view of the sound monitor on a microphone stand according to the present invention.
Figure 4:
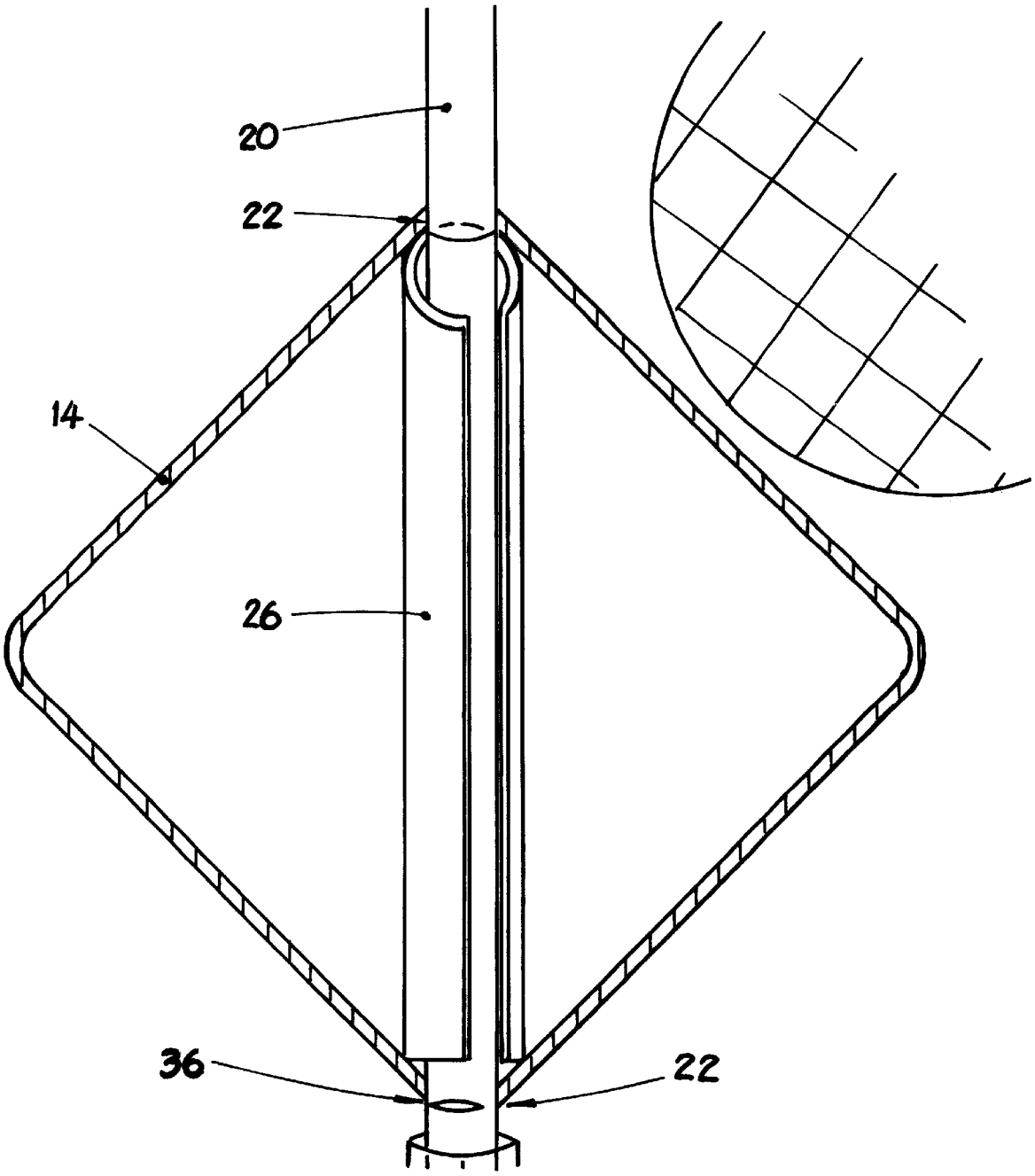
FIG. 4 is a cross-sectional view of the sound monitor on a microphone stand according to the present invention.
Figure 5:
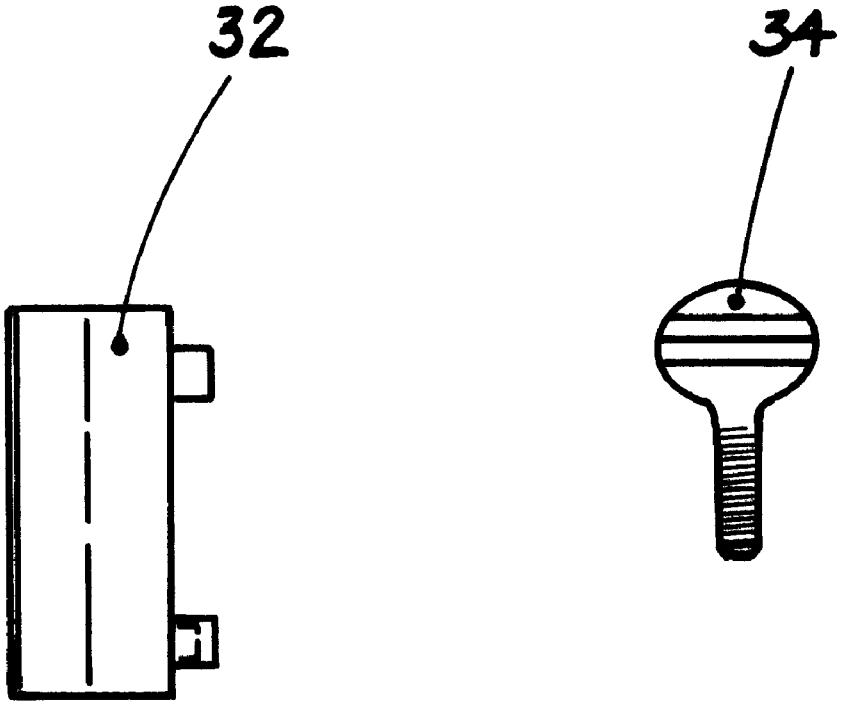
FIG. 5 is a side view of a coupler according to the present invention.

The present invention provides a microphone stand mounted monitor 10 which is closer to the performer 12, eliminates the use of precious floor space, uses less power, allows for a lower output volume on the stage and is adjustable in height. The microphone stand mounted monitor 10 includes a cabinet 14, at least one speaker 16 in the cabinet 14 and a mounting system, as shown in FIGS. 1–7. The monitor 10 mounts to a microphone stand 18 by sliding the cabinet 14 over a shaft 20 with the microphone adapter 21 removed, so that the shaft 20 is inserted into holes 22 of the cabinet 14, as shown in FIGS. 1–7. The holes 22 are positioned so that the cabinet 14 is about waist height of the performer 12 and the speakers 16 of the cabinet 14 are pointed towards the head 24 of a performer 12, as shown in FIG. 1. An isolation tube 26 is mounted inside the cabinet 14 between the holes 22. The isolation tube 26 provides a guide for the shaft 20 and protects the internal parts of the cabinet 12 from the shaft 20. The isolation tube 26 also aids in sealing the cabinet 14 and preventing leakage of sound from the cabinet 14. Sealant 28 can be applied between the holes 22 and the isolation tube 26. The isolation tube 26 can be of a hard such as PVC or soft material such as foam.

Figure 10:
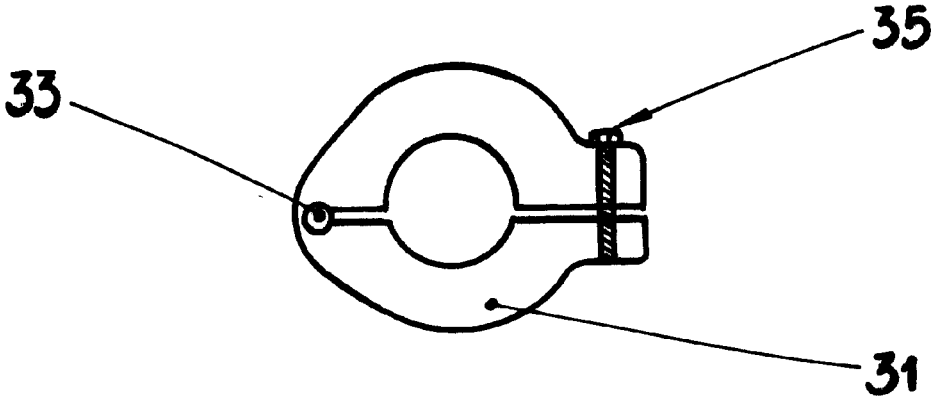
FIG. 10 is a top view of a hinged coupler according to the present invention.

Two embodiments using a collar on the shaft 20 to retain the monitor 10 at the required height on the microphone stand 18 are shown in FIGS. 1–7. FIGS. 1–5 show a first embodiment. The first embodiment employs a steel coupler 32 with set screws 34. The coupler 32 is placed over the shaft 20 before the shaft 20 inserted into the cabinet 14 and the set screws 34 are tighten against the shaft 20 to lock the coupler 32 in place. The cabinet 14 is then place over the shaft 20 and the bottom 36 of the cabinet 14 rests against the coupler 32. The coupler 32 is set at a position on the shaft 20 so that cabinet 14 is at the desired height by the performer 12. The height of the monitor 10 is adjustable by loosening the set screws 34 and adjusting the height of the coupler 32. A second type of coupler with set screw is shown in FIG. 10. FIG. 10 shows a top view where coupler 31 includes a hinge 33 and at least one set screw which closes the coupler 31 around the shaft 20.

Figure 6:
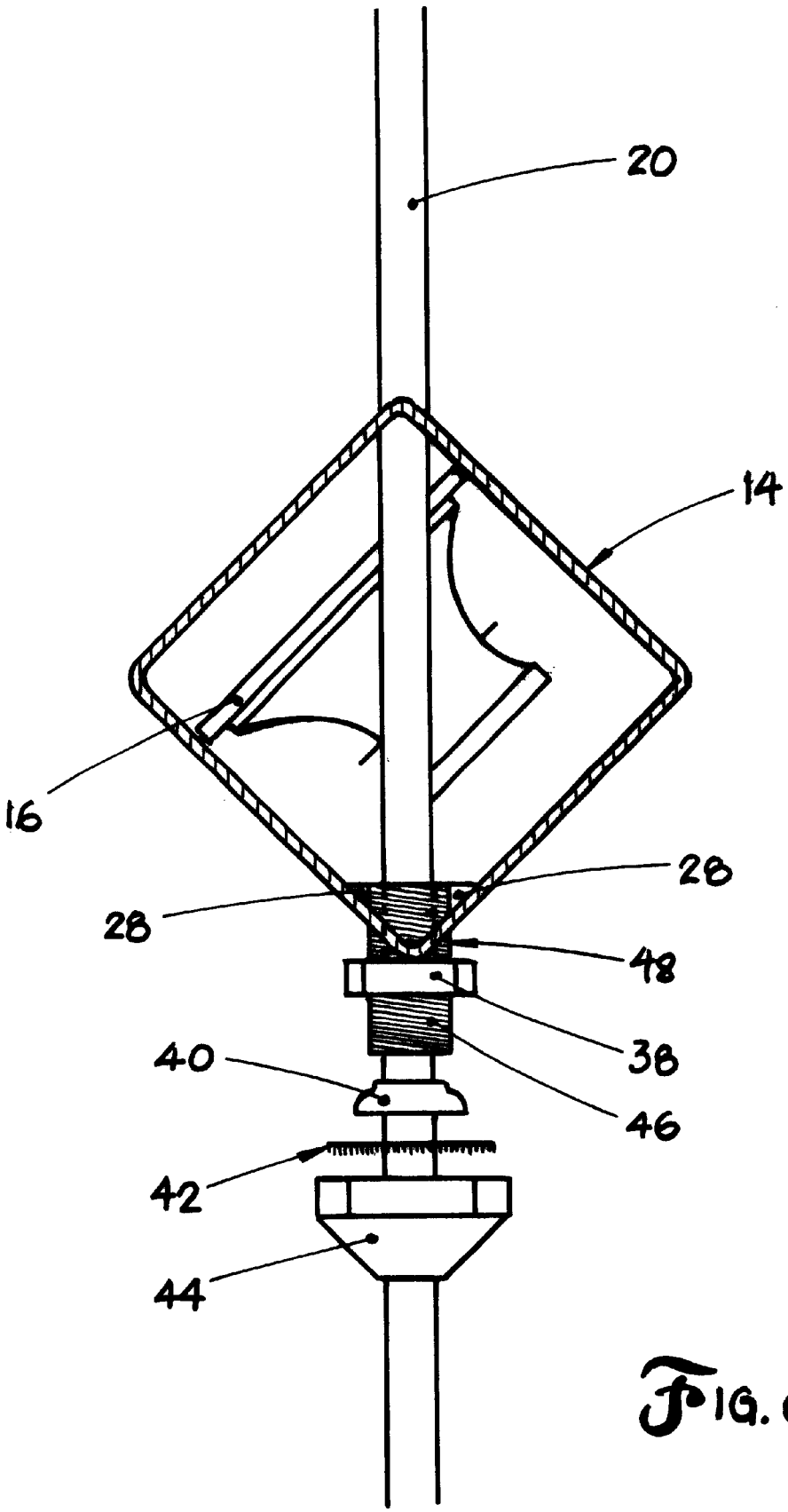
FIG. 6 is a side view of the sound monitor with a compression fitting on a microphone stand according to the present invention.
Figure 7:
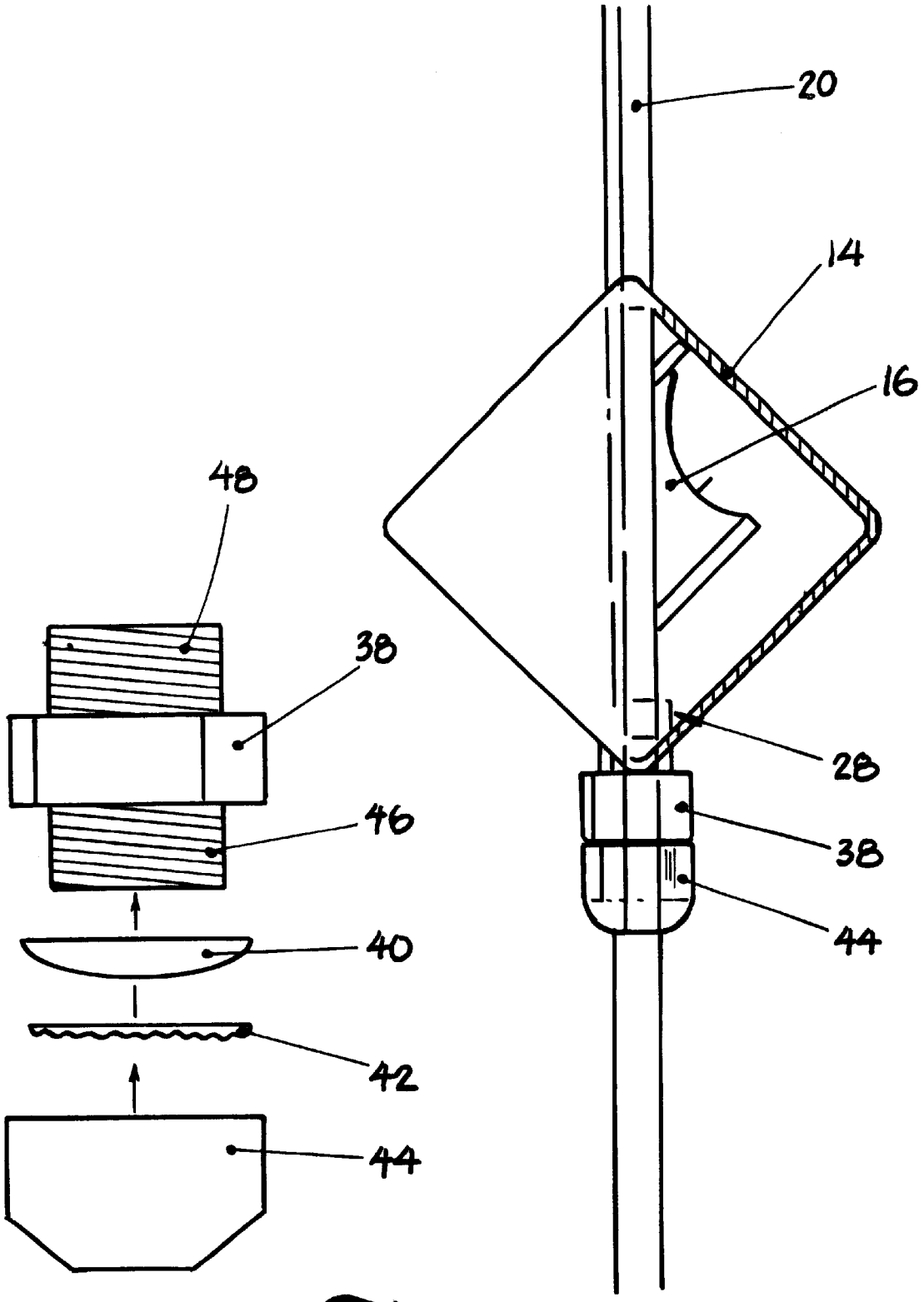
FIG. 7 is a side view of the sound monitor with a compression fitting on a microphone stand according to the present invention.

As shown in FIGS. 6–7, the second embodiment employs a compression fitting including a hollow connector 38, cone 40, gripper ring 42 and nut 44. The connector 38 has at least a first threaded end 46. The connector 38 is glued or screwed into the cabinet 14. If the connector 38 is screwed into the cabinet 14, the connector 38 would have a second threaded end 48 and the bottom hole 22 would be threaded or a nut (not shown) would be used on the inside of the cabinet 14. The nut 44, gripper ring 42 and cone 40 are first placed over the shaft 20, in that order. Then, the shaft 20 is inserted into the connector 39 and the cabinet 14. The cabinet 14 is placed at the desired height on the shaft 20 and the cone 40 and gripper ring 42 are moved towards the connector 38 as the nut 44 is screwed onto the first threaded end 46. The height of the monitor 10 is adjustable by loosening the nut 44, moving the cabinet 14 and retighting the nut 44.

Figure 8:
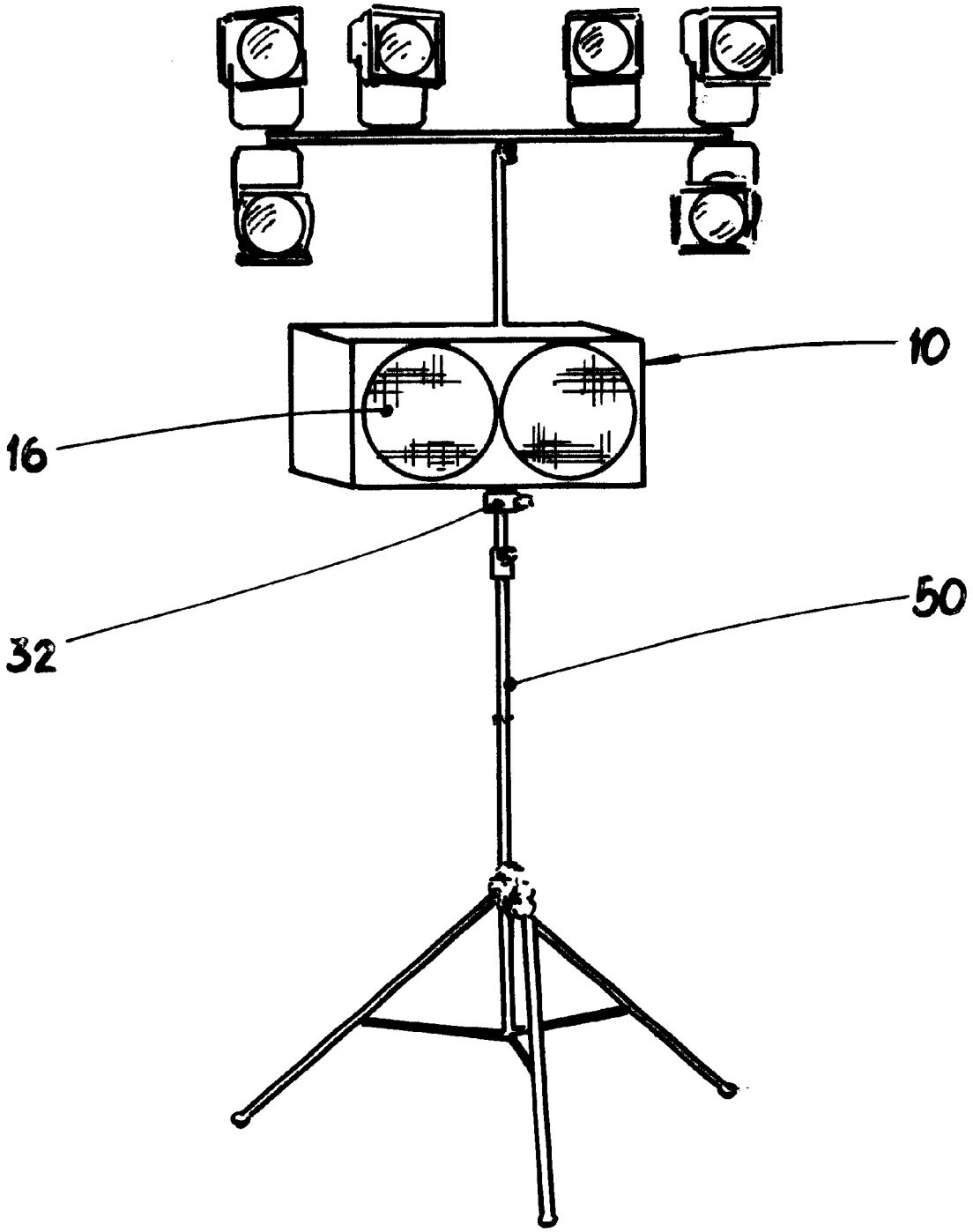
FIG. 8 is a perspective view of the sound monitor on a light stand according to the present invention.
Figure 9:
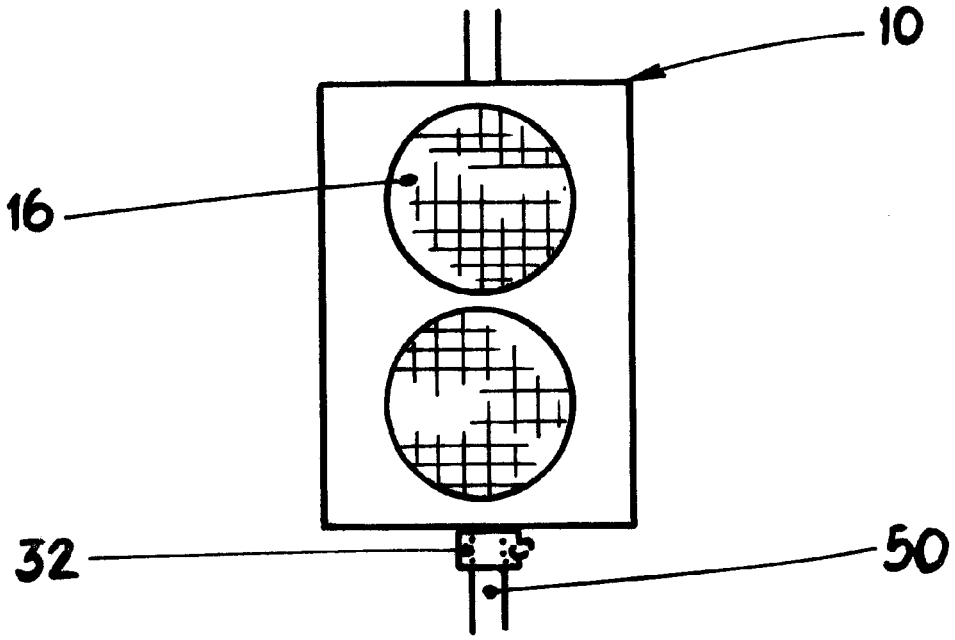
FIG. 9 is a front view of the sound monitor on a stand according to the present invention.

Also, the monitor 10 of the present invention can be mounted on any other type of stand, such as the lighting stand 50 shown in FIGS. 8 and 9. In the case of the lighting stand 50, the holes 22 in the cabinet 14 would be positioned so that the speakers 16 point directly outward at a ninety-degree angle from the lighting stand 50. In all cases of mounting the monitor 10 to a stand, whether a microphone or lighting stand, the holes 22 of the cabinet 14 can be positioned so that the monitor 10 points in a desired direction by the user. FIGS. 8 and 9 show different positioning of the monitor 10, whereby the monitor 10 in FIG. 9 has a position that is rotated ninety-degrees to the position of the monitor 10 shown in FIG. 8.

While different embodiments of the invention has been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

I claim:

1. A sound monitor comprising:

a cabinet having a top, bottom and at least two sides;

at least one speaker in said cabinet;

a first hole in said top;

a second hole in said bottom; and a shaft projecting through said cabinet, wherein said first and second holes are aligned and adapted to receive said shaft projecting thru said cabinet, said shaft adapted to suspend said cabinet in midair such that said at least on speaker is directed towards a user.

2. The sound monitor of claim 1, wherein said holes are positioned such that said cabinet is angled towards a user when placed on said shaft.

3. The sound monitor of claim 1, further including an isolation tube between said holes to act as a guide for said shaft and protect the internal parts of the cabinet from damage from said shaft.

4. The sound monitor of claim 3, wherein said isolation tube is adapted to provide a seal between said holes and said cabinet.

5. The sound monitor of claim 1, further including a collar which sides onto said shaft and before said cabinet and which supports said cabinet on said shaft.

6. The sound monitor of claim 5, wherein said collar is a coupler to slide over said shaft with at least one set screw, said set screw for securing said coupler to said shaft.

7. The sound monitor of claim 6, wherein said set screw is adapted to be turned by hand to allow easy adjustment of said coupler on said shaft.

8. The sound monitor of claim 6, wherein said collar is a compression fitting.

9. The sound monitor of claim 8, wherein said compression fitting includes a hollow connector, cone, gripper ring and nut.

10. The sound monitor of claim 6, wherein said collar is a hinged collar to allow said collar to be applied to the shaft without sliding said collar over said shaft.

11. The sound monitor of claim 1, wherein said shaft is a microphone stand shaft.

12. The sound monitor of claim 1, wherein said shaft is a lighting stand shaft.

* * * * *